US005823937A

United States Patent [19]

Carr

[11] Patent Number: 5,823,937

[45] Date of Patent: Oct. 20, 1998

[54] LOW-SHEAR FEEDING SYSTEM FOR USE WITH CENTRIFUGES

[76] Inventor: Robert B. Carr, 194 Aspinwall Ave., Brookline, Mass. 02146

[21] Appl. No.: 678,489

[22] Filed: Jul. 9, 1996

Related U.S. Application Data

[63] Continuation-in-part of Ser. No. 548,322, Nov. 1, 1995, Pat. No. 5,674,174.

[51] Int. Cl.[6] ..... B04B 9/12; B04B 11/00; B04B 15/08

[52] U.S. Cl. ..... 494/67; 494/61; 494/65

[58] Field of Search ..... 494/5, 6, 60, 61, 494/62, 65, 67, 80, 85, 900; 210/377

[56] References Cited

U.S. PATENT DOCUMENTS

| | | | |
|---|---|---|---|
| 1,048,905 | 12/1912 | Sperry | 210/377 X |
| 2,083,809 | 6/1937 | Asch | 494/65 X |
| 2,593,294 | 4/1952 | Goldberg | 494/65 X |
| 2,785,765 | 3/1957 | Cornell | 494/61 X |
| 2,887,267 | 5/1959 | De Langen | 494/61 X |
| 3,007,629 | 11/1961 | Boyland | 494/61 X |
| 3,023,949 | 3/1962 | Bankerd | 494/65 X |
| 3,327,401 | 6/1967 | Stamos et al. | 210/377 X |
| 3,989,185 | 11/1976 | Mercier | 494/67 |
| 4,030,897 | 6/1977 | Pelzer et al. | 494/61 X |

FOREIGN PATENT DOCUMENTS

| | | | |
|---|---|---|---|
| 551182 | 1/1958 | Canada | 494/61 |
| 2155366 | 9/1985 | United Kingdom | 494/65 |

*Primary Examiner*—Charles E. Cooley
*Attorney, Agent, or Firm*—Testa, Hurwitz & Thibeault, LLP

[57] ABSTRACT

A centrifugal separator for separating the solids component of a feed liquid comprises a bowl that is rotatable about a vertically disposed axis. The bowl has an interior wall, an open upper end, a closed lower end, and a generally cylindrical portion. A feed cone assembly is located at the bottom of the closed conical lower end. The feed cone assembly includes a conical outer wall and an integrally-formed, truncated cusp-shaped hub which extends upwardly towards the interior of the bowl. An annular chamber is located between the conical outer wall and the hub. A feed pipe extends from the upper end of the bowl to the lower end and includes a feed outlet which is sized and shaped to fit within the annular channel. Liquid feed is introduced into the annular channel through the feed pipe while the bowl rotates. Centrifugal force moves liquid in the annular channel outwardly along the smooth contours of the channel and onto the conical wall of the feed cone. The liquid gradually and gently moves up along the outwardly tapering conical wall, increasing its rotational velocity until it blends with the liquid located within the spinning bowl. In another embodiment, the bowl includes an open lower end and a closed upper end. An inverted feed cone is positioned at the upper end and includes a rounded cusp-shaped diverter whose surface gradually merges with the outer conical wall of the feed cone and defines an annular channel. A feed pipe extends from the lower open end and includes a feed applicator which is positioned coaxially with and adjacent to the cusp-shaped diverter. The feed applicator is sized and shaped to closely follow the contours of the cusp-shaped diverter so that as the bowl is rotated, liquid feed forced through the feed pipe is applied to the outer surface of the spinning cusp-shaped diverter and is gradually and gently introduced to the conical wall of the feed cone and into the generally cylindrical portion of the spinning bowl. In another embodiment, a vacuum within a predetermined range is applied within the bowl to reduce power consumption and foaming.

1 Claim, 6 Drawing Sheets

LOW-SHEAR FEEDING SYSTEM FOR USE WITH CENTRIFUGES

This is a continuation-in-part of Ser. No. 08/548,322, filed Nov. 1, 1995, U.S. Pat. No. 5,674,174.

FIELD OF THE INVENTION

This invention generally relates to centrifuges, and more particularly, to feeding systems used in centrifuges to introduce a liquid suspension into a separation bowl.

BACKGROUND OF THE INVENTION

Centrifugal separators include a bowl adapted to rotate and separate the components of a liquid suspension (or feed liquid) according to their different specific gravities, generally resulting in a dense solids cake compressed tightly against the wall surface of the bowl, and a less-dense pool of clarified liquid located radially inwardly of the solids cake. As the bowl rotates, both the solids cake and the pool of clarified liquid rotate at approximately the rotational speed of the bowl.

During typical prior art separation processes, the feed liquid is introduced into an already rotating bowl. Many commercial centrifuges, such as solid bowl basket type centrifuges introduce the feed liquid directly into the rotating liquid pool. This causes a high level of turbulence in the pool which reduces the separating efficiency and the degree of liquid clarification.

Other centrifuges such as decanter, tube bowl and disc stack centrifuges, introduce the feed liquid through mechanical feed distributors which commonly include vanes, flutes, ridges, or other mechanisms that provide rapid and positive acceleration of the feed stream in the shortest possible time. The high rate of acceleration imposed on the feed liquid introduces shear force to the feed liquid which can damage fragile liquids and solids even prior to their separation.

Frequently, the feed mechanisms of these prior art devices require that the feed liquid pass through one of several small diameter holes in the bowl. As the liquid passes through these holes, it is accelerated, almost instantly, from a relatively slow rotational flow to the angular velocity of the radially inward surface of the liquid pool. It is at this point of acceleration where high shear forces are applied to the liquid. The high shear forces can easily destroy an unacceptable percentage of the solid component of the liquid feed prior to separation.

In other prior separation devices, such as decanters and tube bowl separators, the feed liquid is required to jump an air gap from the feed distributor to the liquid pool. As in the other prior art devices discussed above, this type of feed mechanism introduces the feed liquid to the liquid pool in a traumatic manner which again creates both high shear and turbulence at the point of impact.

It is therefore an object of the invention to provide a feed mechanism for use with centrifugal separators which overcomes the deficiencies of the prior art.

It is another object of the invention to provide such a feed mechanism which introduces liquid feed to a rotating liquid pool within a rotating bowl of a centrifugal separator without exerting high shear forces to the liquid feed.

It is another object of the invention to operate a centrifugal separator with less power and with less foaming.

SUMMARY OF THE INVENTION

A centrifugal separator for separating the solids component of a feed liquid comprises a bowl that is rotatable about a vertically disposed axis. The bowl has an interior wall, an open upper end, a closed lower end, and a generally cylindrical portion. Located at the bottom of the closed conical lower end and along the vertical axis is a feed cone assembly. The feed cone assembly includes a conical outer wall and an integrally formed truncated cusp-shaped hub which extends upwardly towards the interior of the bowl. Located between the conical outer wall and the hub is a torroidally shaped annular channel. A feed pipe extends from the upper end of the bowl to the lower end and includes a feed outlet which is sized and shaped to fit within the annular channel. Liquid feed is introduced into the annular channel through the feed pipe while the bowl rotates. Centrifugal force moves liquid in the annular channel outwardly along the smooth contours of the channel an onto the conical wall of the feed cone. The liquid gradually and gently moves up along the outwardly tapering conical wall of the centrifuge, increasing its rotational velocity until it blends with the liquid located within the spinning bowl.

In another embodiment, the bowl includes an open lower end and a closed upper end. An inverted feed cone is positioned at the upper end and includes a central rounded cusp-shaped diverter whose surface gradually merges with the outer conical wall and defines an annular channel. A feed pipe extends from the lower open end and includes a feed applicator which is positioned coaxially with and adjacent to the cusp-shaped diverter. The feed applicator is sized and shaped to closely follow the contours of the cusp-shaped diverter so that as the bowl is rotated, liquid feed forced through the feed pipe is applied to the outer surface of the spinning cusp-shaped diverter and is gradually and gently introduced to the conical wall of the feed cone and into the generally cylindrical portion of the spinning bowl.

DETAILED DESCRIPTION OF THE PREFERRED EMBODIMENT

Figure 1:
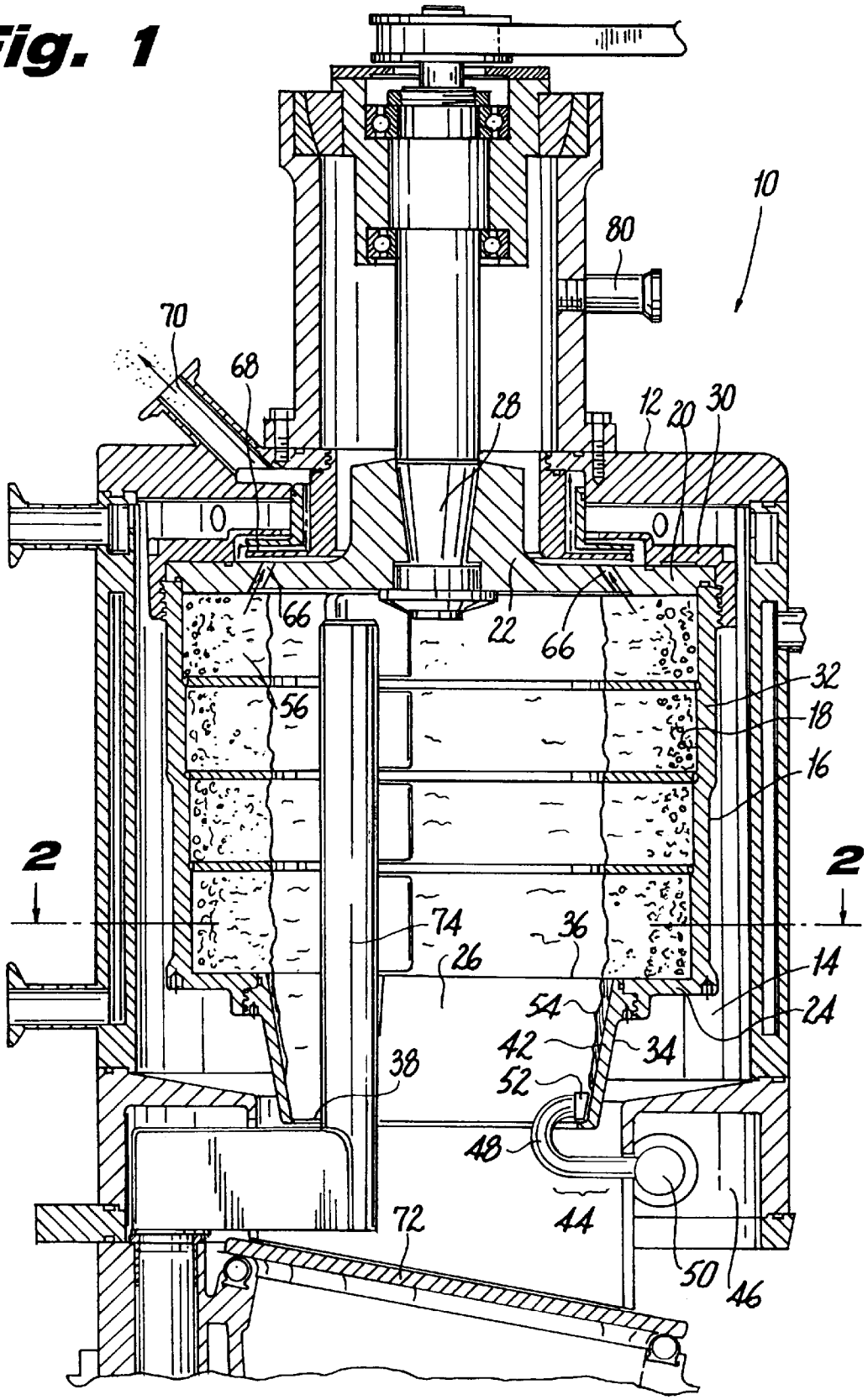
FIG. 1 is a sectional view of a centrifugal separator, in accordance with the invention, showing details of a scraper assembly, a washing sprayer, a feed applicator, and a feed distributor, during a feed mode of a separation cycle.

Referring to FIG. 1, a centrifugal separator 10 is shown, in accordance with the invention, including a housing 12 with a separation chamber 14, and a bowl 16. The bowl 16 is rotatably supported within the separation chamber 14 and includes a generally cylindrical wall 18, an upper end plate 20 having an integrally formed connecting hub 22, and a lower end plate 24 having a central opening 26. The connecting hub 22 is adapted to be connected to a drive shaft 28, which is driven by a motor (not shown). The upper end plate 20 is circular and adapted to be attached to the upper rim of the cylindrical wall 18, by a threaded end cap 30 whose threads engage mating threads formed along an outer surface 32 of the cylindrical wall 18.

The lower end plate 24 is similarly disc shaped having a circular outside peripheral edge which is preferably integrally formed with the lower edge of the cylindrical wall 18. The end plate 24 includes an inside peripheral edge 32 which defines the central opening 26 and which is preferably threaded. A feed distributor cone 34 is attached to the lower end plate 24 with mating threads located along an upper edge 36 of the wide-diameter end of the cone 34. The feed distributor cone 34, as shown in FIGS. 1 and 3–5, includes a lower circular edge 38 which defines a discharge opening 40 and a smooth wall surface 42.

Figure 2:
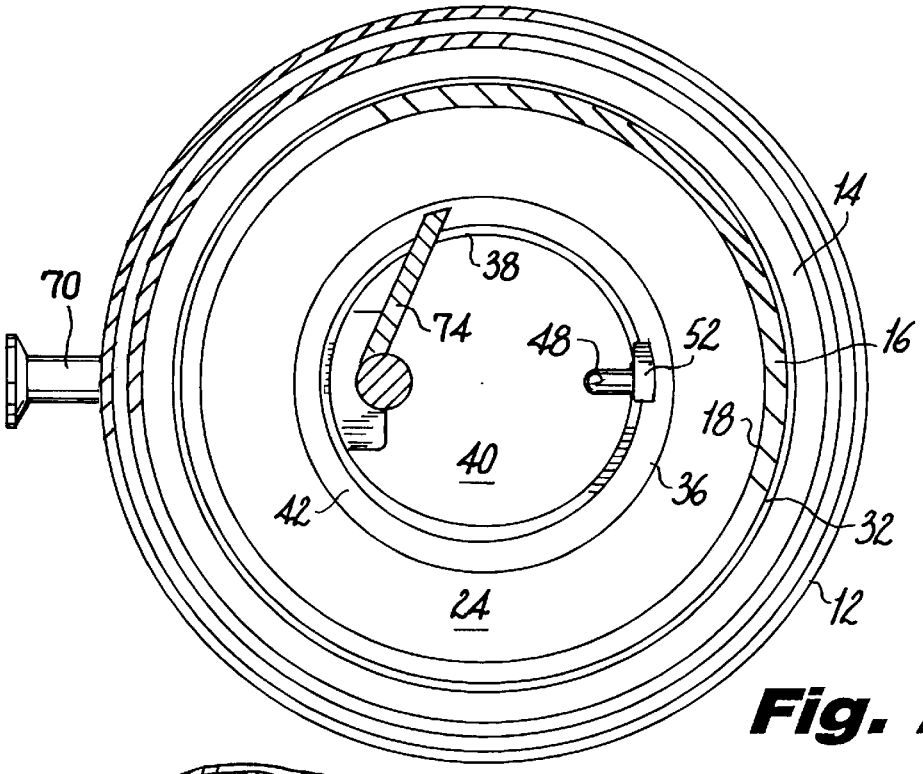
FIG. 2 is a top sectional view of the centrifugal separator, taken along the lines 2—2 of FIG. 1, in accordance with the invention.
Figure 3:
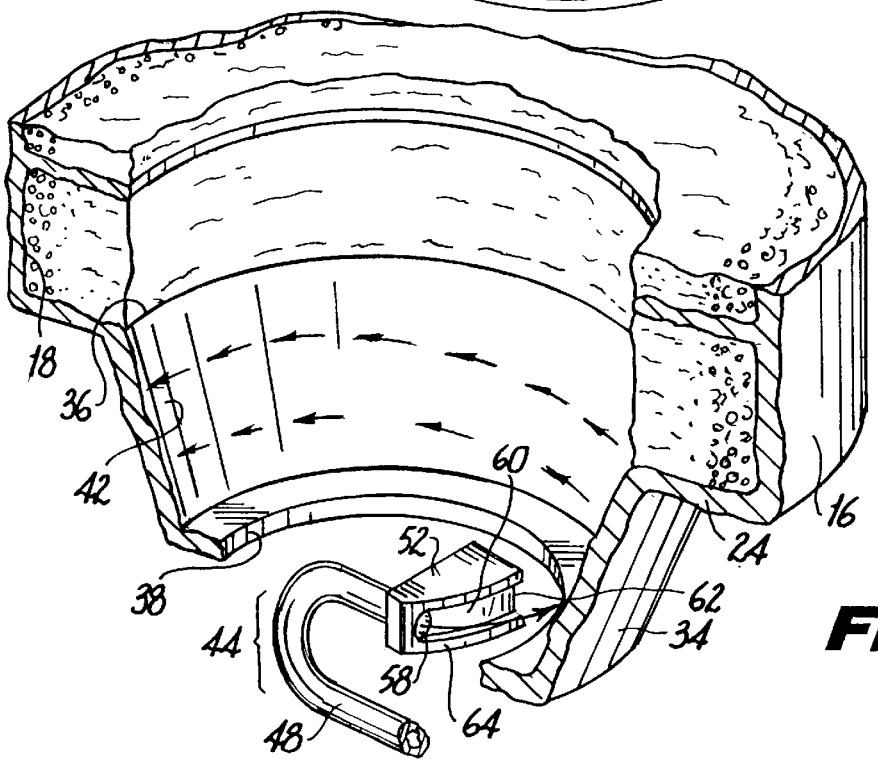
FIG. 3 is a sectional perspective view of a portion of the centrifugal separator of FIG. 1, showing details of the feed distributor and the feed applicator, during the feed mode and in accordance with the invention.

A feed applicator assembly 44 is pivotally mounted to the housing 12 within cavity 46 and includes a feed tube 48, a pivotal fluid coupling 50 and an applicator head 52. The feed applicator assembly 44 is adapted to be selectively pivoted between a stowed position located within the cavity 46, shown in FIGS. 4 and 5, and an application position wherein the applicator head 52 is positioned through the discharge opening 40 and immediately adjacent to the wall surface 42, as shown in FIGS. 1, 2 and 3.

In accordance with the invention, the purpose of the feed applicator assembly 44 and the feed distributor cone 34 is to minimize trauma to the liquid feed 54, by allowing the angular velocity of the applied liquid feed 54 to gradually increase up to the angular velocity of the liquid pool 56 located in the bowl 16. The feed liquid 52 is applied to the smooth wall surface 42 of the feed distributor cone 34 adjacent the lower edge 38. Owing to the smaller-diameter of the lower edge 38 of the distributor cone 34, the angular velocity of the wall surface 42 at the lower edge 38 is less than the angular velocity of the upper edge 36 of the cone 34 and is also less than the angular velocity of the surface of the liquid pool 56 within the bowl 16. Once applied, the liquid feed 54, as shown in FIG. 3, slowly accelerates and rises, in a somewhat spiral path, along the wall surface 42 of the distributor cone 34, until it reaches and combines with the liquid pool with equal (or near equal) angular velocities.

The applicator head 52 preferably includes an inlet 58, a channel 60, and an outlet 62. The head 52 preferably includes an outer surface 64 which has a portion (adjacent to the outlet 62) which is shaped similar to the curvature and vertical angle of the distributor cone 34. The channel 60 which is formed into the outer surface 64 and connects the inlet 58 with the outlet 62 is adapted to not interfere with adjacent moving liquid feed. The inlet 58 is connected to the feed tube 48 so that any liquid feed 54 that is forced through the feed tube 48 will pass through the inlet 58 of the applicator head 52 and into the channel 60. The newly applied liquid feed located within the channel 60 will interact with the adjacent moving feed located along the wall surface 42 of the distributor cone 34 and will accelerate smoothly within the channel 60 and out through the outlet 62 to make the transition from the feed tube 48 (zero angular velocity) to the angular velocity of the adjacent feed liquid located on the wall surface 42 of the distributor cone 34.

The feed liquid is effectively "painted" by the applicator head 52 onto the smooth rotating wall surface 42 of the distribution cone 34 and thereby greatly reduces the "trauma" from the high shear forces experienced by the solids component of the feed liquid during injection into the rotating bowls of the prior art centrifugal separators. The separator 10 of the present invention preferably operates with the surface of the liquid pool located at either the upper edge 36 of the distributor cone 34 as shown in FIGS. 1 and 3 or against the wall surface 42 of the distributor cone 34 (between the upper and lower edges of the cone). With the operating liquid pool 56 rotating against the wall surface 42 of the cone 34 or adjacent to its upper edge 36, the feed liquid 54 may more gently combine with the liquid pool 56 without trauma.

By gently accelerating the feed liquid 54 up to the angular velocity of the surface of the liquid pool 56 inside the bowl 16, using the distributor cone 34 and the applicator head 52, the centrifugal separator 10 may efficiently process shear sensitive fluids or fluids containing fragile solids such as whole cells or flocculants, and any fluids that tend to foam or froth.

As the feed liquid 54 is continuously introduced into the rotating bowl 16 along the smooth wall surface 42 of the distributor cone 34, the portion of the feed liquid making up the liquid pool 56 already in the bowl 16 is rotating at a high angular velocity and its solid components are being influenced by centrifugal forces as high as 20,000 G's (gravities). These centrifugal forces pull the solids out of the liquid pool and compress them against the wall surface 18 of the bowl 16, leaving a clarified liquid pool 56 near the upper end plate 20 within the bowl 16. Due to a slightly upwardly directed conical shape of the wall surface of the bowl 16, the liquid pool is gradually forced upwardly towards the upper end plate 20 as the bowl rotates. The upper end plate 20 includes openings 66 which are positioned within the now clarified liquid pool. The clarified liquid pool 56 is continuously removed from the bowl 16 through the openings 66, at a rate equal to the rate of feed liquid application, with any appropriate method, but preferably using a centripetal pump 68 located between the end cap 30 and the upper end plate 20. The clarified liquid pool is pumped from the separator 10 through appropriate conduits 70 to a remote location (not shown).

In operation, the bowl 16 of the separator 10 is rotated at a predetermined speed. The feed applicator assembly 44 is pivoted about the pivotal fluid coupling 50 so that it pivots from its stowed position within the cavity 46 to its application position with the applicator head 52 located adjacent to the wall surface 42 of the distributor cone 34, as shown in FIGS. 1 and 3. A feed liquid 54 is forced through the feed tube 48 to the application head 52 and into a channel 60 from an inlet 58. The feed liquid 54 is directed to flow within the channel 60 in the direction of rotation of the bowl 16 and the distributor cone 34. The feed liquid 54 leaves the channel 60 of the applicator head 52 at the outlet 62, preferably at the same angular velocity as that of the adjacent wall surface 42 of the distributor cone 34, and is directed to flow against the rotating wall surface 42. The transition from the applicator head 52 and the wall surface 42 is smooth and in a manner which minimizes turbulence.

Once the feed liquid 54 is applied to the wall surface 42 and rotates, it is influenced by a centrifugal force which, owing to the upwardly directed distributor cone 34, slowly forces the feed liquid upwardly along the wall surface 42. As the feed liquid rises in response to the centrifugal force, the effective diameter of the wall surface 42 increases and, therefore, so does the angular velocity and the magnitude of the centrifugal force. The result is that the feed liquid 54 gradually and gently rotates with greater angular velocity and spirals against the wall surface 42 upwards towards the surface of the bowl 16, as illustrated by the arrows of FIG. 3.

A liquid pool 56 has been established within the bowl 16 and has a surface which contacts the lower end plate 24 at the peripheral edge of the central opening 26, as shown in FIG. 3, or the wall surface 42 of the distributor cone 34. In either case, the transition between the conical wall surface 42 and the surface of the liquid pool 56 is smooth and gradual so that the feed liquid may merge into the liquid pool 56 with an equal (or close to equal) angular velocity to that of the liquid pool 56. The smooth transition of the feed liquid into the liquid pool 56 generates low (or effectively no) shear forces and leaves the liquid pool 56 free of undesirable turbulence.

As the liquid pool 56 rotates within the bowl 16, centrifugal forces separate out its solid components and compacts them against the wall 18 of the bowl 16. The result is a clarified liquid pool 56 located at the top of the bowl 16, adjacent the upper end plate 20. The clarified liquid 56 is removed from the bowl 16 through the openings 66 and removed from the separator 10 by a centripetal pump 68 and appropriate conduit 70, as is appreciated by those skilled in the art.

Once a predetermined amount of solids cake is collected against the wall 18 of the bowl 16, the flow of feed liquid 54 through the feed tube 48 is stopped and the feed applicator assembly 44 is pivoted about the pivotal fluid coupling 50 to its stowed position within the cavity, as the system begins a drain mode followed by a discharge mode.

Figure 4:
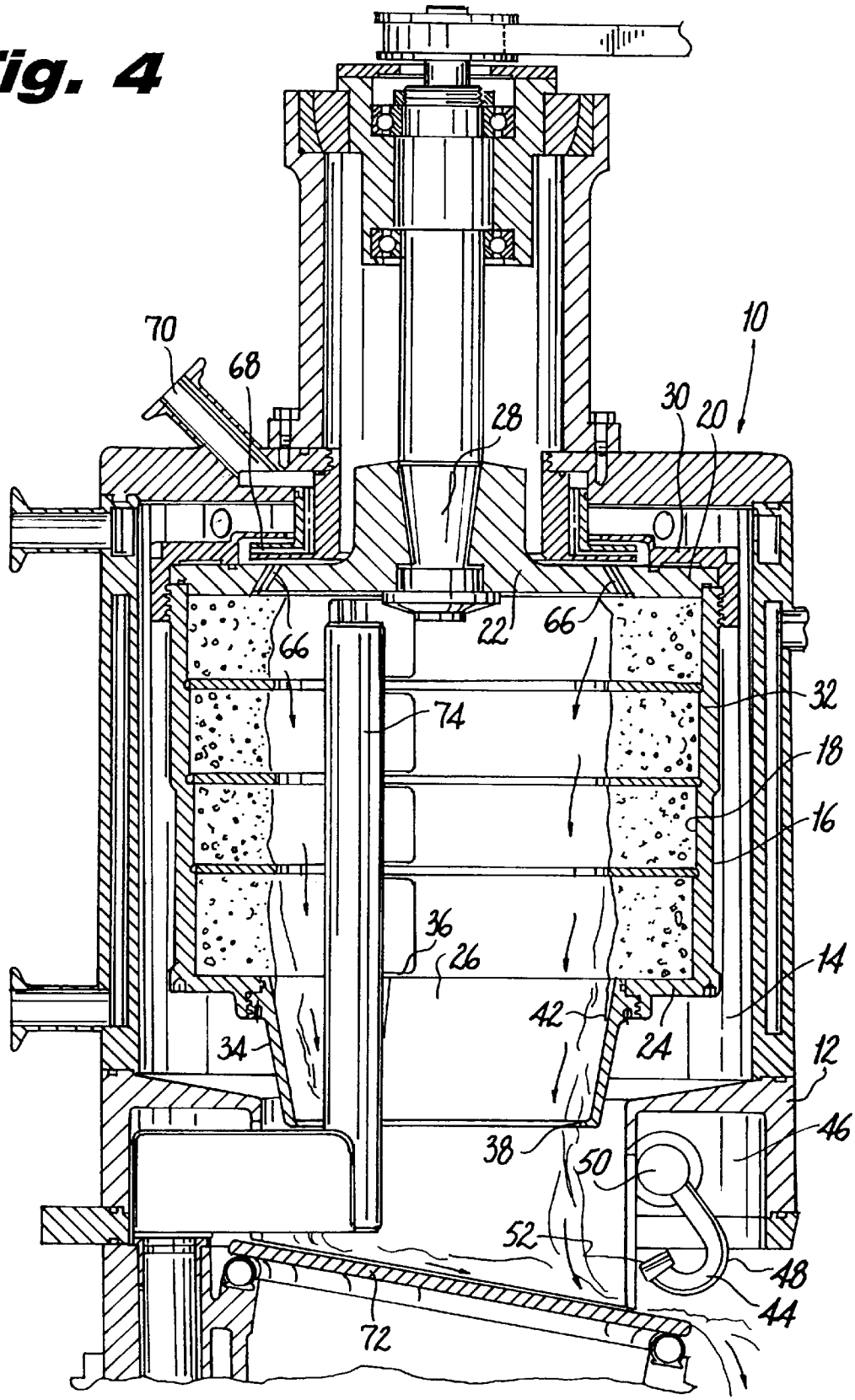
FIG. 4 is a sectional view of the centrifugal separator of FIG. 1, showing the relative position of the feed applicator during a drain mode, in accordance with the invention.
Figure 5:
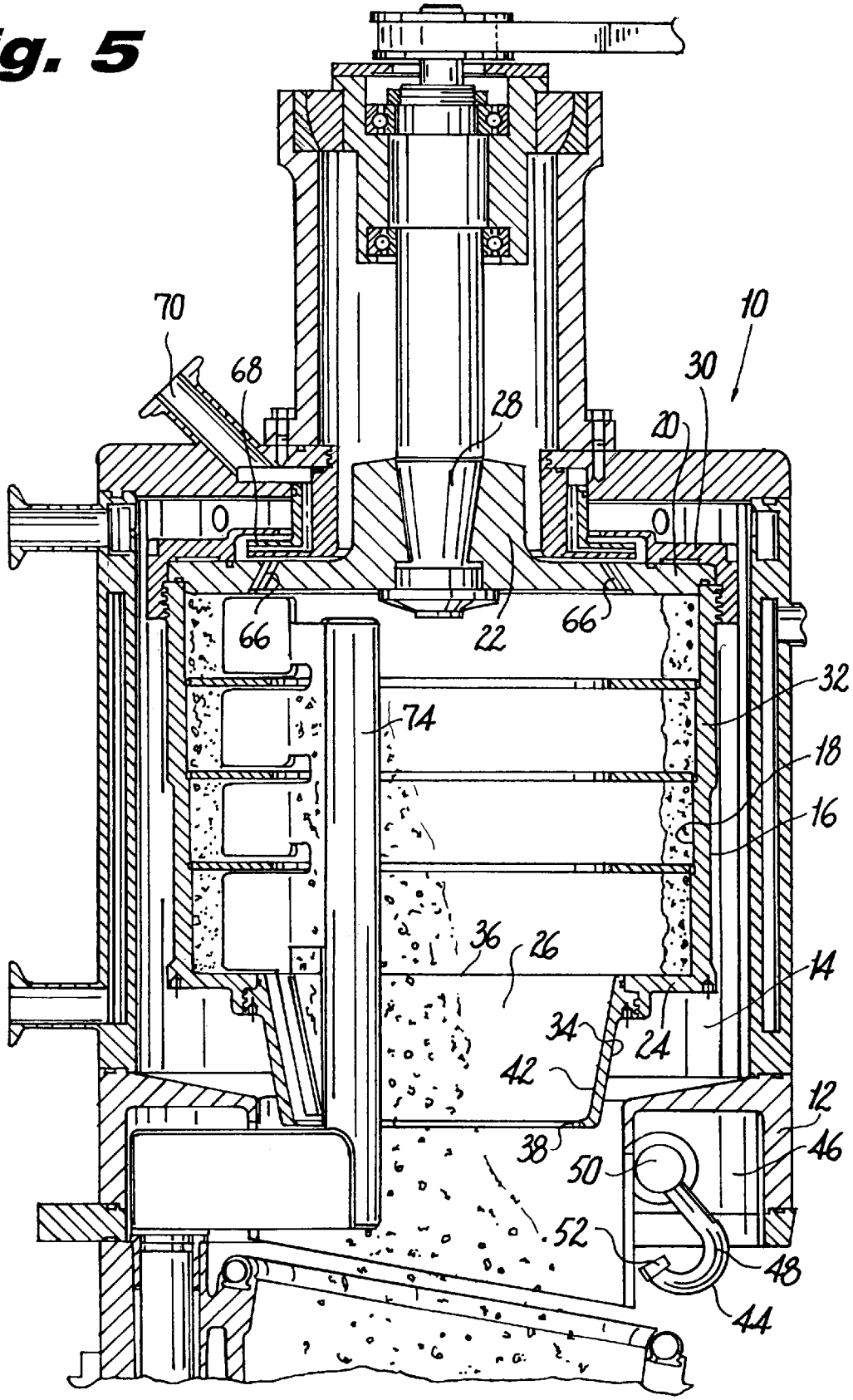
FIG. 5 is a sectional view of the centrifugal separator of FIG. 1, showing the relative position of the feed applicator during a discharge mode, in accordance with the invention.

When the feed applicator assembly 44 is within the cavity 46, the bowl 16 is slowly slowed down and gently stopped. As the bowl slows its rotation, the residual liquid remaining in the bowl 16 drains through the discharge opening 40, against a solids gate 72 (which is closed) and handled appropriately thereafter, as shown in FIG. 4, as understood by those skilled in the art.

Once the drain mode is complete and an acceptable amount of residual liquid has been removed from the solids cake, the solids gate 72 is moved to an open position and an appropriate scraper assembly 74 is advanced towards the wall 18 to remove the solids from the bowl 16. The dislodged solids fall through the discharge opening 40, past the solids gate 72 and are collected appropriately, as desired.

During the drain and discharge modes of operation, the feed applicator assembly 44 remains within the cavity 46, protected from any passing solids cake or liquid.

By removing the clarified liquid from the upper end plate 20, above and remote from where the solids cake forms within the bowl 16, the openings 66 are not at risk of clogging or contamination during the drain and discharge modes of operation, as are the clean-liquid discharge openings of prior art separators which are typically located at the bottom of the bowl, below the collected solids.

Figure 6:
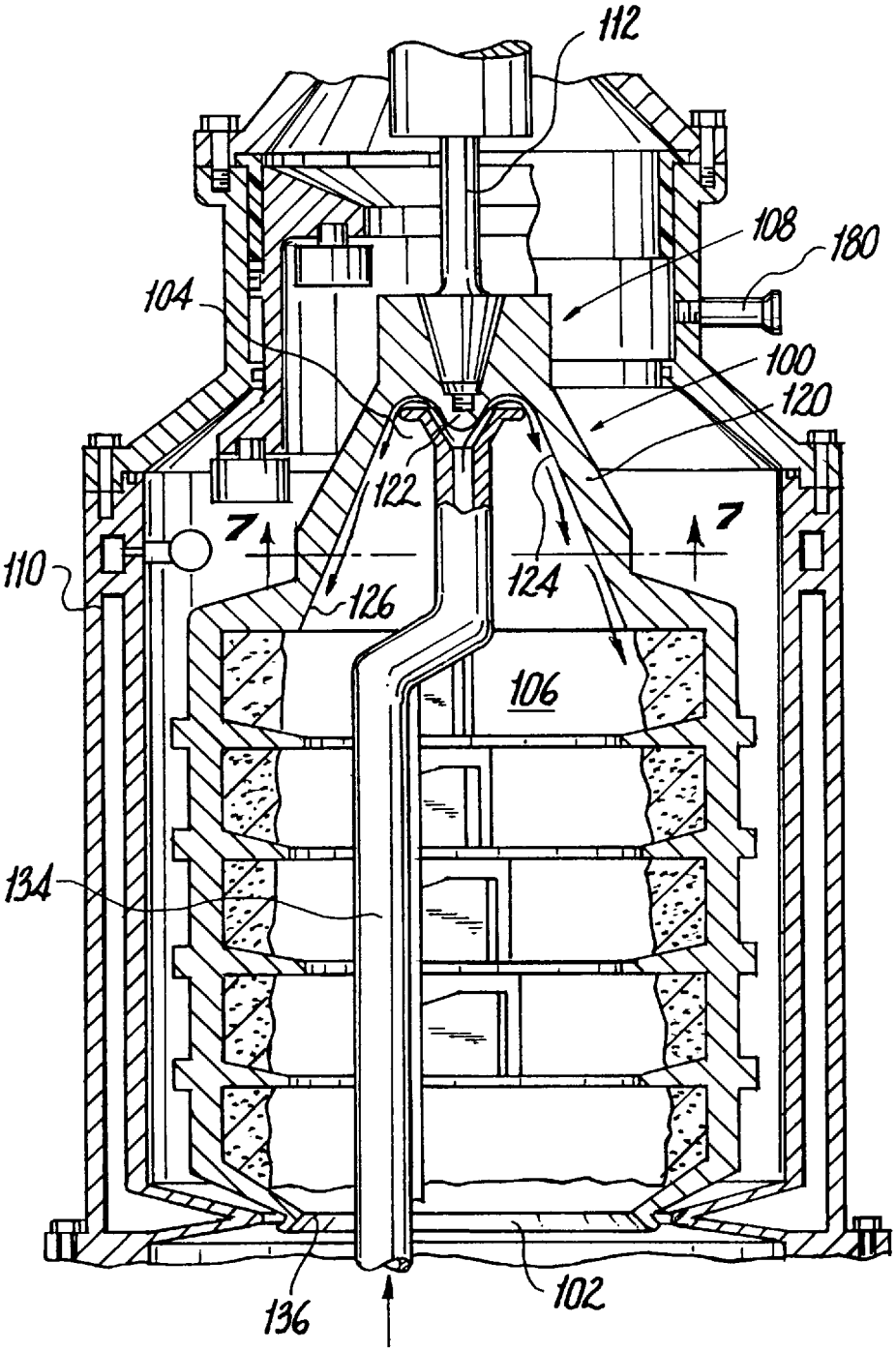
FIG. 6 is a partial sectional view of a centrifuge separator, according to another embodiment of the invention, showing an inverted feed cone and a feed tube.
Figure 7:
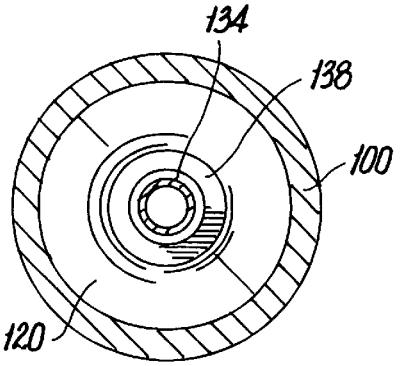
FIG. 7 is sectional view of the centrifuge separator, taken along the line 7—7 of FIG. 6, showing details of the feed cone and the feed tube, according to the invention.
Figure 10:
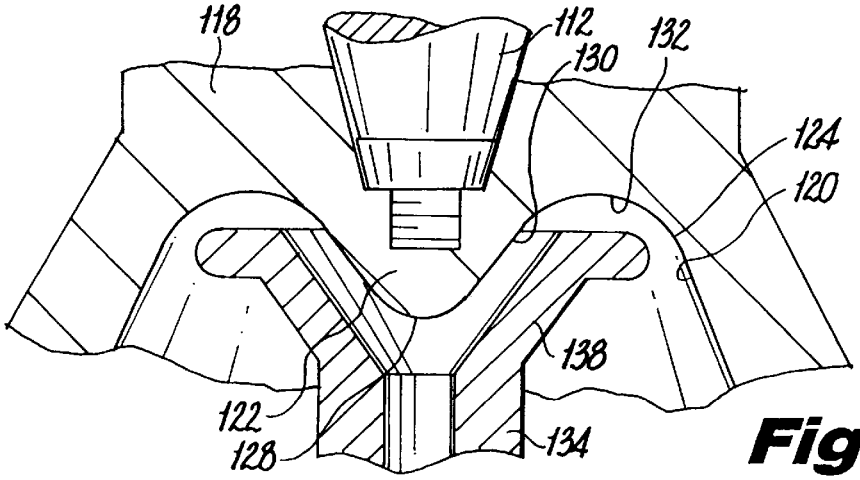
FIG. 10 is an enlarged partial view of the centrifuge separator of FIG. 6, showing details of a fluid diverter and the feed cone, according to the invention.

In accordance with another embodiment of the invention, referring to FIGS. 6–7 and 10, a separation bowl 100 includes an open lower end 102, an upper end 104, a collection region 106, and a feed cone assembly 108. Separation bowl 100 is supported within a housing 110 and attached to a spindle 112. Spindle 112 is rotatable through a motor and belt arrangement (not shown) as is conventionally known.

In this embodiment, feed cone 108 is inverted and includes a central hub 118, an integral conical wall 120 diverging outwardly and downwardly (towards bowl 100) from a centrally located fluid diverter 122. Conical wall 120 includes an upper end 124 having a small diameter, and a lower end 126 having a large diameter. The shape of fluid diverter 122 is that of an inverted rounded cusp whose apex 128 is a rounded convex shape and whose circular base 130 merges with conical wall 120, defining an annular channel 132 having a convex cross sectional shape, as shown in FIG. 7.

A feed pipe 134 is located within bowl 100, passing through an opening 136 located at lower end 102. Feed pipe 134 is at least partially coaxial with spindle 112 and includes an upper discharge outlet 138 which is flared radially outward. The shape of discharge outlet 138 is preferably similar to the shape of diverter 122 and extends into annular channel 132 so that liquid feed discharged from feed pipe 134 (during rotation of bowl 100) contacts the surface of diverter 122 and begins to gently rotate. As centrifugal force increases, its influence gradually forces discharged liquid along the curved surface of annular channel 132, downwardly along conical wall 120, and radially outwardly, until the liquid eventually merges with clarified liquid 140 located within bowl 100.

As is conventionally known, the liquid feed located within the collection region 106 reaches maximum angular velocity and is separated, forming clarified liquid 140 and solids 142. Clarified liquid 140 located within bowl 100 gradually moves downwardly within bowl 100 and exits through opening 136 in a continuous manner, as liquid feed enters.

Figure 8:
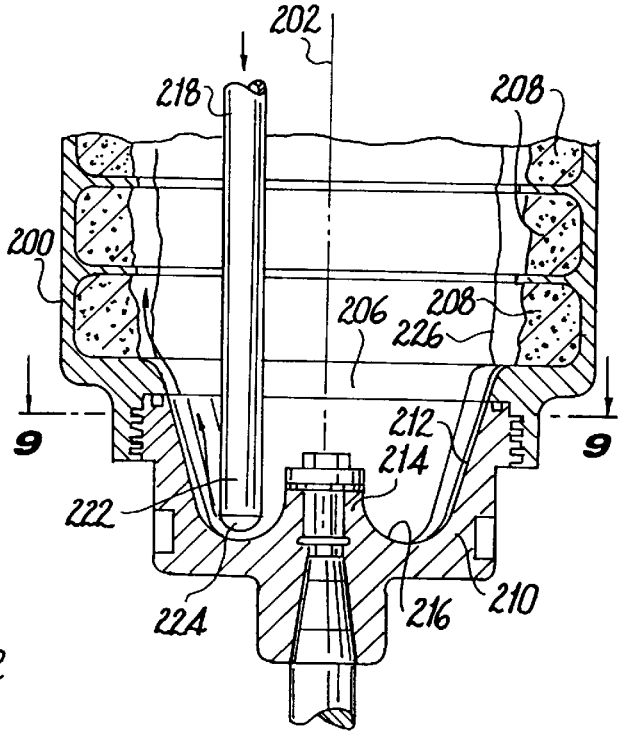
FIG. 8 is a partial sectional view of a centrifuge separator, according to yet another embodiment of the invention, showing an upright feed cone.
Figure 9:
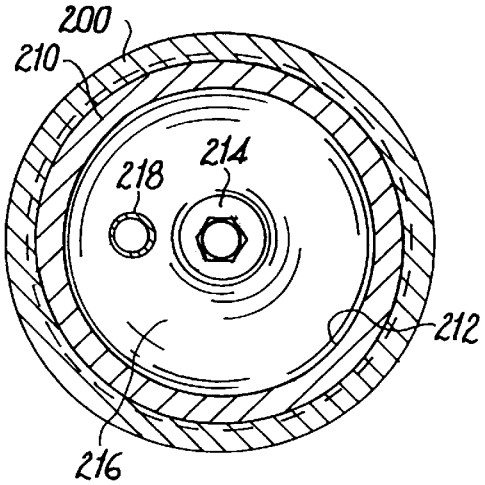
FIG. 9 is a sectional view of the centrifuge separator, taken along the line 9—9 of FIG. 8, showing the feed cone and feed tube, according to the invention.

In another embodiment of the invention, as shown in FIGS. 8–9, bowl 200 is rotatably mounted within a housing (not shown) along a vertical axis 202, and includes an upper end (not shown), a lower end 206 and a collection region 208. The upper end can be of conventional structure or may be, for example, an upper end plate that includes openings that are in fluid communication with a centripetal pump as described above and as illustrated in FIGS. 1–5. A feed cone assembly 210 is connected to lower end 206 and includes a conical wall 212 tapering radially inwardly away from bowl 200, a centrally disposed hub 214, and an annular channel 216 located between hub 214 and conical wall 212. Annular channel 216 forms a smooth concave cross-section as shown in FIG. 8.

A feed pipe 218 is positioned through the upper end and includes a lower discharge end 222. Feed pipe 218 is preferably positioned parallel to and displaced from vertical axis 203 so that discharge end 222 lies within annular channel 216. An outlet opening 224 of discharge end 222 is located close to the surface of annular channel 216 so that liquid feed passing through outlet opening 224 makes a smooth transition onto the surface of annular channel 216.

Once within annular channel 216, liquid feed rotates with the spinning feed cone assembly. Centrifugal force displaces the liquid outwardly and upwardly along the conical wall 212 to merge with clarified liquid 226 located within collection region 208 of bowl 200.

According to another embodiment, a centrifuge includes a housing having a chamber and a rotatably supported bowl located within the chamber. As illustrated in FIGS. 1 and 6, the chamber is provided with negative pressure via a vacuum port 80, 180, which is preferably connected to a vacuum pump (not shown). The vacuum pump applies a negative pressure to the chamber of a magnitude equal to about 20–29 in. of Hg so that the resulting vacuum influences the contents of the bowl during separation. While it has been known to apply a vacuum in a test tube centrifuge, the present inventor has discovered that separating liquid feed in a process type of centrifugal separator while under the influence of a vacuum minimizes foaming of the introduced liquid feed and of the clarified liquid. A process type of centrifugal separator is one where feed liquid is substantially continuously introduced into the centrifuge and a clarified liquid is substantially continuously removed from the centrifuge. The benefits of minimizing foaming include, inter alia, increased overall separation efficiency for the centrifuge because foam has been eliminated from the feed cone. The efficiency increases because air bubbles tend to trap fine particles and carry them along through the bowl to the discharge, thereby preventing separation of these fine particles. The present inventor has surprisingly discovered that when a vacuum is applied to the chamber, the feed rate can be increased by as much as four times. Additionally, by reducing foaming, the liquid feed is exposed to less oxygen, which can degrade some fluids. The heating of the liquid can also be reduced due to the elimination of wind friction. Finally, considerably less power is used to operate the centrifuge when a negative pressure is applied in the chamber in the centrifuge. In some embodiments, the present inventors have surprisingly found that up to an 80% reduction of power can be achieved on some relatively larger machines. When, the pressure is closer to about 20 in of Hg, relatively less power is used and when the pressure is closer to about 29 in of Hg, relatively less foaming occurs. Of course, the exact pressure that is maintained in the chamber depends on the requirements of the operator.

Where the foregoing description and drawings represent the preferred embodiment of the present invention, it will be obvious to those skilled in the art that various changes and modifications may be made therein without departing from the true spirit and scope of the present invention.

What is claimed is:

1. A centrifugal separator for separating the solids component of a feed liquid, comprising:

a cylindrical collection bowl being rotatable about a vertical axis, said cylindrical collection bowl having an open lower end and a closed upper end centered about said vertical axis;

an inverted feed cone located at said closed upper end of said cylindrical collection bowl, said feed cone including a conical wall opening into said cylindrical collection bowl and an annular channel located remote of said cylindrical collection bowl, said annular channel having a radially outward wall which merges with said conical wall and a radially inward wall which projects toward said cylindrical collection bowl, converging at said vertical axis and defining a generally cusp-shaped diverter; and a feed tube located within said cylindrical collection bowl, said feed tube being adapted to introduce said feed liquid into said cylindrical collection bowl, said feed tube including an outlet which is shaped similar to said generally cusp-shaped diverter, said outlet located adjacent to and coaxial with said generally cusp-shaped diverter;

whereby said feed liquid introduced through said feed tube contacts said generally cusp-shaped diverter, moves along said annular channel, said radially outward wall and said conical wall and into said cylindrical collection bowl to be separated.

* * * * *